US009004719B2

(12) United States Patent
Quaal et al.

(10) Patent No.: US 9,004,719 B2
(45) Date of Patent: Apr. 14, 2015

(54) TRIM CAP ILLUMINATED CHANNEL LETTER LIGHTING SYSTEM AND LETTER CONSTRUCTION SYSTEM

(71) Applicants: Bruce Quaal, Ventura, CA (US); Timothy Drew Ferrie, Ojai, CA (US); Justin Lind, Camarillo, CA (US); Chad Chu, Camarillo, CA (US); Aaron Meyer, Ventura, CA (US)

(72) Inventors: Bruce Quaal, Ventura, CA (US); Timothy Drew Ferrie, Ojai, CA (US); Justin Lind, Camarillo, CA (US); Chad Chu, Camarillo, CA (US); Aaron Meyer, Ventura, CA (US)

(73) Assignee: The Sloan Company, Inc., Ventura, CA (US)

( * ) Notice: Subject to any disclaimer, the term of this patent is extended or adjusted under 35 U.S.C. 154(b) by 105 days.

(21) Appl. No.: 13/830,694

(22) Filed: Mar. 14, 2013

(65) Prior Publication Data

US 2014/0268741 A1 Sep. 18, 2014

(51) Int. Cl.
*F21V 1/00* (2006.01)
*G09F 13/04* (2006.01)

(52) U.S. Cl.
CPC ..... *G09F 13/0404* (2013.01)

(58) Field of Classification Search
USPC ..... 362/238, 249.02, 240
See application file for complete search history.

(56) References Cited

U.S. PATENT DOCUMENTS

| | | | | |
|---|---|---|---|---|
| 2003/0067789 | A1* | 4/2003 | Velez | 362/555 |
| 2003/0112627 | A1* | 6/2003 | Deese | 362/249 |
| 2006/0087844 | A1* | 4/2006 | Swaris et al. | 362/249 |
| 2012/0002427 | A1* | 1/2012 | Moon et al. | 362/382 |
| 2013/0039063 | A1 | 2/2013 | Quaal et al. | |

OTHER PUBLICATIONS

International Search Report and Written Opinion from PCT/US2014/028277, dated Jul. 17, 2014.

* cited by examiner

*Primary Examiner* — Evan Dzierzynski
(74) *Attorney, Agent, or Firm* — Koppel, Patrick, Heybl & Philpott

(57) ABSTRACT

A channel letter lighting system comprising a channel letter housing including a light transmissive face, a rear wall and at least one trim cap adapted to receive the light transmissive face and rear wall. A plurality of light emitting units within the channel letter housing and at least one optical element proximate the plurality of light emitting units, wherein the at least one optical element is configured to direct light emitted from the plurality of light emitting units in a direction away from the face and towards the rear wall or the opposing trim cap. The channel letter lighting system arranged to provide low profile channel letters.

33 Claims, 2 Drawing Sheets

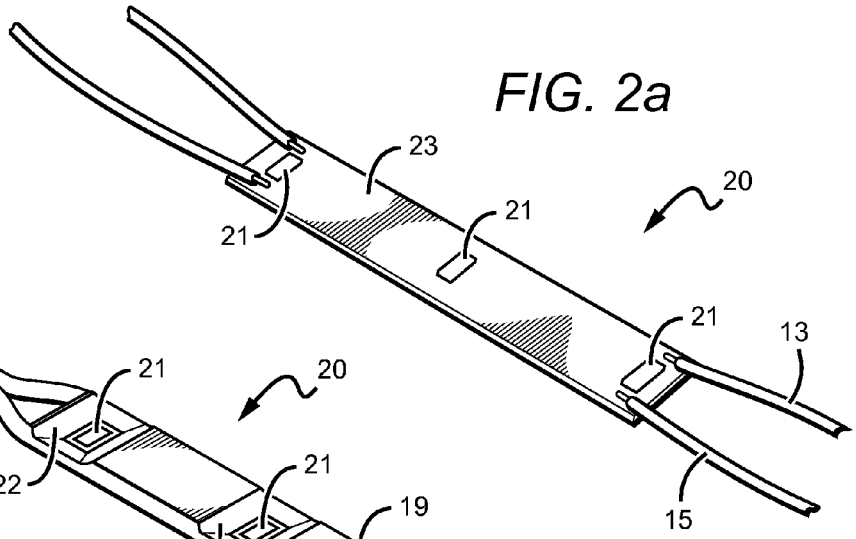
FIG. 2a
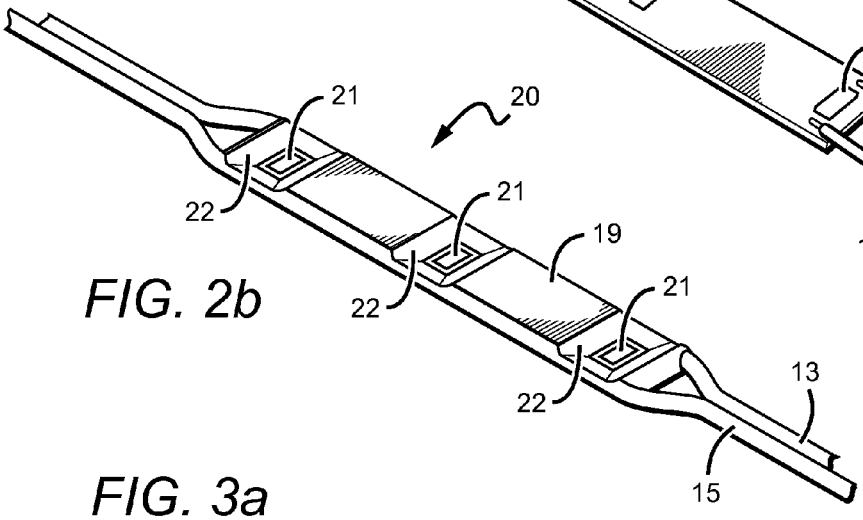
FIG. 2b
FIG. 3a
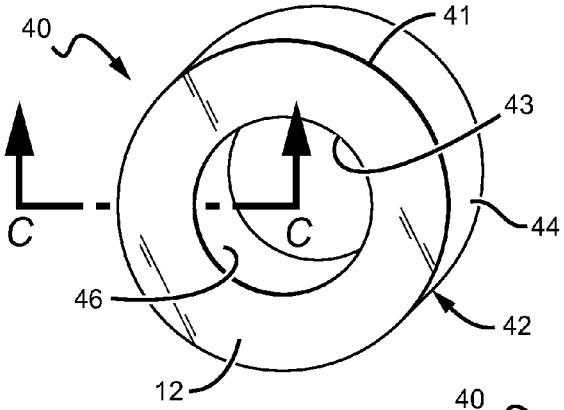
FIG. 3b
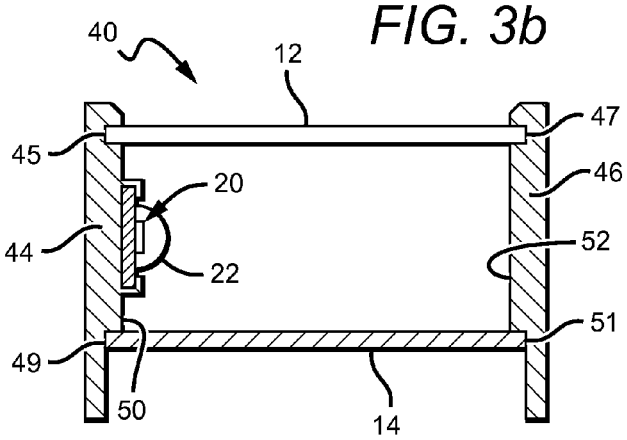

TRIM CAP ILLUMINATED CHANNEL LETTER LIGHTING SYSTEM AND LETTER CONSTRUCTION SYSTEM

BACKGROUND OF THE INVENTION

1. Field of the Invention

This invention generally relates to channel letter lighting systems, and more particularly to LED based low profile channel letter lighting systems.

2. Description of the Related Art

Display units, such as light boxes, cabinet signs and channel letters are commonly found on the outside of buildings or businesses and are often used to advertise the name of the business or products. Typical light boxes and cabinet signs are constructed of aluminum or plastic housing having the shape of a box and are approximately 5" deep. The housing sometimes has a swing open frame to allow for easily changing the advertising graphics within. The top opening in the housing, or surface, is covered by a translucent or clear lens that transmits light from within the housing. The advertisement graphic is placed under this lens so that it is between the lens and the lighting units inside the light box. This allows the graphic to be illuminated from behind by the lighting units within the light box. In some cases the translucent lens itself may be the illuminated graphic.

Typical channel letters display units can be constructed of aluminum or plastic housings having the shape of a letter, wherein each housing is an individual structure having separate illumination. Channel letter display units can be produced in almost any font, color or size. Typical channel letter display units are approximately 5 inches deep. The housing has a face, a rear wall, and sidewalls, with a light source within the housing such that the housing emits light out the face and/or the back of the housing.

To enhance the visibility of these display units, different types of lighting units are incorporated. Various types of lighting systems are used with different light sources such as incandescent bulbs, neon bulbs or fluorescent tubes. One of the problems associated with the conventional lighting units and systems is that their light sources can experience relatively short lifespans and they can have relatively low electrical efficiency. Incandescent bulbs, neon bulbs and fluorescent tubes have a relatively short lifespan, particularly when compared to other light sources, such as typical LEDs. These light sources are also electrically inefficient and providing sufficient lighting, especially in large lighting applications, requires the consumption of significant energy. For example, a standard fluorescent tube 60 inches in length consumes as much as 60 to 70 Watts, and conventional display units can utilize many of these tubes. Neon bulbs can also experience difficulty with cold starting, which can lead to failure of the neon bulb.

More recently, with the advent of the efficient solid state lighting sources, these display units have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent, fluorescent or neon lights. Incandescent lights are very energy-inefficient light sources with a vast majority of the electricity they consume being released as heat rather than light. Fluorescent light bulbs are more energy efficient than incandescent light bulbs, but are still relatively inefficient. Neon light tubes need to be bent or formed into the shape corresponding to the housing, which can be labor intensive, especially for channel letter housings. As such, neon tubes are fragile and are more susceptible to breakage during transit and installation. Neon light tubes are powered by 4,000-15,000 Volts AC and present a significantly higher electrical hazard potential. LEDs by contrast, can emit the same luminous flux as incandescent, fluorescent or neon lights using a fraction of the energy.

In addition, LEDs can have a significantly longer operational lifetime. Incandescent light bulbs have relatively short lifetimes, with some having a lifetime in the range of about 750-1,000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours.

The increased efficiency and extended lifetime of LEDs is attractive to many lighting suppliers and has resulted in LED lights being used in place of conventional lighting in different sign applications. For example, to illuminate a typical channel letter display unit, an array of LED light units can be mounted to the rear wall and direct light towards the face. To optimize efficiency, the LED light units of the array are typically spaced from one another as far as possible before any dark spots are noticeable on the face. To prevent dark spots, the LED light units are spaced close enough to one another so that the light beam pattern generated by each LED light unit overlaps an adjacent LED light unit as the emitted light contacts the face. The face is thereby illuminated in a generally even manner having no bright spots or dark spots.

Channel letters are also manufactured having a shallow housing depth of approximately 2 inches, which can also be called low profile channel letters. However, mounting the LED light units on the rear wall could result in the channel letter exhibiting bright and/or dark spots on the face because of reduced overlap of emitted light from the LED light units.

SUMMARY OF THE INVENTION

A channel letter lighting system is presented which overcomes the problems noted above. A channel letter housing comprises a light transmissive face, a rear wall opposite the light transmissive face and at least one trim cap. The at least one trim cap receives the light transmissive face and the rear wall to form the channel letter housing. A plurality of light emitting units are on the trim cap, and at least one optical element proximate the plurality of light emitting units and configured to direct light emitted from the plurality of light emitting units in a direction away from the face and towards the rear wall or the opposing trim cap. The light emitted from the plurality of light emitting units is reflected by the opposing trim cap or the rear wall towards the face and out the housing.

In another embodiment, a channel letter lighting system comprises a channel letter housing including a front surface, a rear wall and at least one trim cap along the outer edges of the front surface and rear wall. An array of light emitting units mounted within the housing, wherein each of the lighting units comprises at least one light emitting element on a printed circuit board (PCB) electrically connected to first and second conductors, and an optical element proximate the at least one light emitting element, such that light is emitted towards the opposing trim cap or the rear wall, such that the light emitted from the array of light emitting units is evenly distributed along the front surface.

These and other features, aspects and advantages of the invention will become better understood with reference to the following description and claims.

BRIEF DESCRIPTION OF THE DRAWINGS

FIG. 2*a* is a perspective view of a light emitting unit according to an embodiment of the invention.

FIG. 2*b* is a perspective view of a light emitting unit according to an embodiment of the invention.

FIG. 3*a* is a perspective view of a channel letter lighting system according to an embodiment of the invention.

FIG. 3*b* is a cross sectional view of the channel letter lighting system of FIG. 3*a*.

DETAILED DESCRIPTION OF THE INVENTION

Figure 1A:
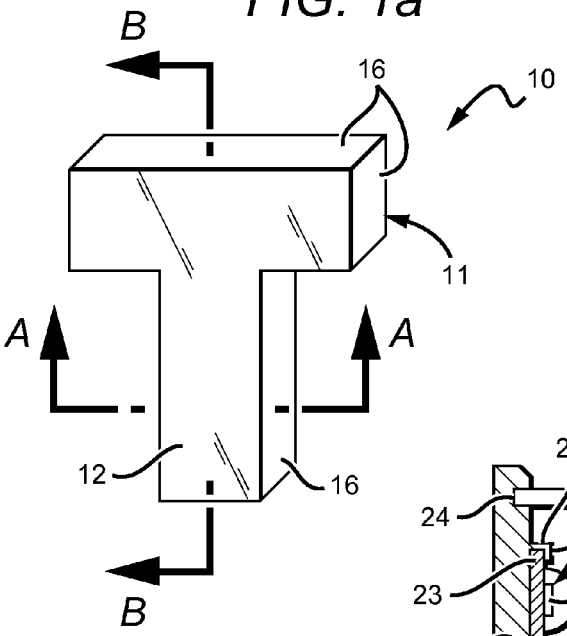
FIG. 1*a* is a perspective view of a channel letter lighting system according to an embodiment of the invention.

Embodiments of the invention provide a channel letter lighting system that utilizes light emitting units having a controlled emission and generally arranged to provide uniform illumination to a channel letter.

The systems according to the present invention provide lighting units that are interconnected in a chain by electrical conductors so that an electrical signal applied to the input end of the conductors spreads to the lighting units, causing them to emit light. The lighting unit can comprise many different materials and can be used in many different lighting applications, such as but not limited to channel letter lighting. The lighting unit according to the present invention can be arranged in many different ways with many different components, and is generally arranged to provide uniform illumination to a channel letter.

The invention is described herein with reference to certain embodiments, but it is understood that the invention can be embodied in many different forms and should not be construed as limited to the embodiments set forth herein. In particular, the present invention is described below in regards to certain lighting units in different configurations, but it is understood that the invention can be used for many other devices having many different configurations. The components can have different shapes and sizes beyond those shown in the figures or discussed herein.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

Figure 1B:
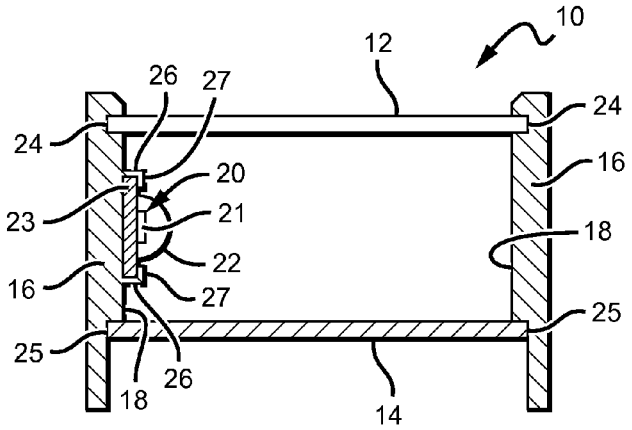
FIG. 1*b* is a cross sectional view of the channel letter lighting system of FIG. 1*a*.
Figure 1C:
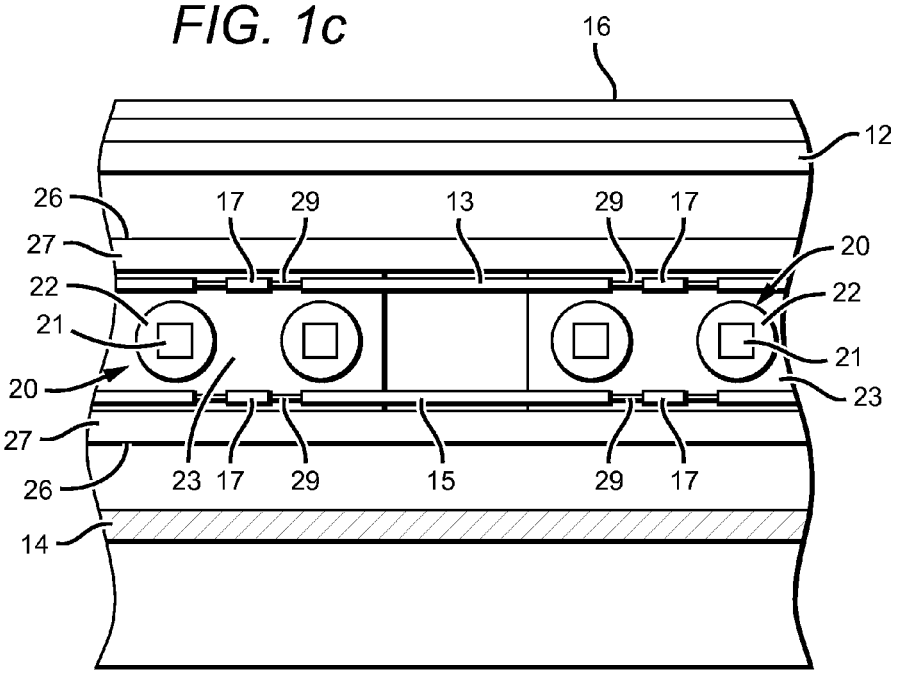
FIG. 1*c* is another cross sectional view of the channel letter lighting system of FIG. 1*a*.

FIGS. 1*a*-1*c* show one embodiment of a channel letter lighting system 10 according to the invention. The channel letter lighting system 10 comprises a channel letter housing 11 having a light transmissive face 12, a rear wall 14 opposite the light transmissive face and at least one trim cap 16. The at least one trim cap 16 is arranged to receive the light transmissive face 12 and the rear wall 14 to form side wall surfaces 18 of the channel letter housing 11. A plurality of light emitting units 20 are within the channel letter housing on the at least one trim cap 16. The plurality of light emitting units 20 are electrically connected together by first and second electrical conductors 13, 15, thereby forming an array of light emitting units. Each of the light emitting units 20 are adapted to emit light in response to an electrical signal. The electrical conductors 13, 15 conduct electricity to the light emitting units 20 and an electrical signal applied to the conductors 13, 15 at one end of the channel letter lighting system 10 is conducted to each of the light emitting units 20 so that the plurality of light emitting units 20 simultaneously emit light. The light emitting units 20 are arranged such that, when illuminated, give the appearance that the channel letter housing 11 has a continuous light source.

The at least one trim cap 16 comprises a slot 24 and is arranged to receive the light transmissive face 12. In one embodiment of the invention, the light transmissive face 12 is fabricated into the shape of a desired letter and the outer edge of the transmissive face 12 is coupled to at least one trim cap 16. The outer edge of the transmissive face 12 is inserted into the slot 24 of the at least one trim cap 16, such that the trim cap 16 extends along the entire perimeter of the light transmissive face 12. The at least one trim cap 16 extending along the entire perimeter of the light transmissive face 12 forms the side wall surfaces 18 of the channel letter housing 11. The light transmissive face 12 can be coupled to the at least one trim cap 16 by using an adhesive, bonding compound, mechanical fasteners, or any other means known in the art.

The at least one trim cap 16 further comprises a recess 25 opposite the slot 24 arranged to receive the rear wall 14. The rear wall is shaped similar to the light transmissive face 12. The outer edge of the rear wall 14 is coupled to the at least one trim cap 16. The outer edge of the rear wall 14 is positioned within the recess 25 of the at least one trim cap 16, such that the at least one trim cap 16 extends along the entire perimeter of the rear wall 14. The at least one trim cap 16 extending along the entire perimeter of the rear wall 14 further forms the side wall surfaces 18 of the channel letter housing 11. The rear wall 14 can be coupled to the at least one trim cap 16 by using an adhesive, bonding compound, mechanical fasteners, screws, nails, rivets or any other means known in the art. After the face 12 and rear wall 14 are received by the at least one trim cap 16, the ends of the at least one trim cap can be coupled to each other to enclose the housing 11. The ends of the trim cap can be coupled using a coupler shaped to receive the ends of the trim cap. While in other embodiments the ends of the trim cap can be coupled using an adhesive, epoxy, bonding agent or mechanical fastener, such as but not limited to screws, nails, rivets or the like.

When the light transmissive face 12 and the rear wall are coupled to the at least one trim cap 16, the channel letter housing 11 is formed and encloses the plurality of light emitting units within the channel letter housing 11. In the embodiment discussed above, the light transmissive face 12 is coupled to the at least one trim cap 16 prior to the rear wall 14. However, the invention is not intended to be limited to the order of coupling the light transmissive face 12 and rear wall 14 to the at least one trim cap 16 of such embodiment. In other embodiments, the rear wall 14 can be coupled to the at least one trim cap 16 prior to the light transmissive face 12. In yet other embodiments, the light transmissive face 12 and the rear wall 14 can be coupled to the at least one trim cap 16 at the same time.

An advantage of the invention is that the channel letter lighting system can be arranged to provide a low profile channel letter while using conventional ⅛ inch or 3/16 inch nominal acrylic face material. Conventional low profile channel letters use very thick, diffusive and expensive acrylic for the face material in order to provide proper light diffusion. The invention configured to utilize conventional face material reduces the weight of the channel letter lighting system, and also saves cost in material, shipping and manufacturing of low profile channel letters.

In the embodiment of FIG. 1*a*, the channel letter housing 11 is in the form of the letter "T". The at least one trim cap 16 extends along the perimeter of the light transmissive face 12 and the rear wall 14 in order to form the side wall surfaces 18. The at least one trim cap 16 is adapted to be shaped into many different shapes to receive the light transmissive face 12 and the rear wall 14. The at least one trim cap 16 can be made of many different materials, such as but not limited to, aluminum, steel, plastic, rubber, fiber glass, or the like, or a combination thereof.

FIG. 1*b* shows a cross sectional view of the channel letter lighting system 10 of FIG. 1*a* along the line A-A. The at least one trim cap 16 receives the light transmissive face 12 and the rear wall 14 and forms the side wall surfaces 18. As shown in FIG. 1*b*, the at least one trim cap 16 forms side wall surfaces 18, wherein one side wall surface is opposite another side wall surface. In other embodiments, the at least one trim cap 16 can be arranged to form adjacent side wall surfaces in addition to opposing side wall surfaces, especially in embodiments where the light transmissive face 12 and the rear wall 14 have corners or pointed edges. The at least one trim cap 16 extends along the perimeter of the light transmissive face 12 and the rear wall 14, the at least one trim cap 16 may be bent to form corner and/or pointed bends to accommodate the shapes of the light transmissive face and the rear wall, which results in the at least one trim cap 16 forming adjacent side wall surfaces and opposing side wall surfaces.

The plurality of light emitting units 20 are disposed on at least one side wall surface 18 of the at least one trim cap 16. The at least one trim cap 16 can be configured to receive the plurality of light emitting units 20. In one embodiment, the at least one trim cap 16 comprises a plurality of extensions 26 on an internal surface of the at least one trim cap 16, wherein each of the plurality of extensions 26 comprise a respective ridge 27. The plurality of light emitting units 20 are adapted to be received by the plurality of extensions 26 and secured by the respective ridges 27. The plurality of extensions 26 and respective ridges 27 allows the plurality of light emitting units 20 to be slidably received by the at least one trim cap 16. This configuration allows the plurality of light emitting units 20 to be secured and held in place by the ridges 27. However, in other embodiments, the plurality of light emitting units 20 can also be coupled to the at least one trim cap 16 in addition to being held by the ridges 27 in order to further secure the plurality of light emitting units 20 to the at least one trim cap 16. For example, glue or any other adhesive, epoxy, or other bonding agent can be applied to the plurality of light emitting units 20 to couple the plurality of light emitting units to the at least one trim cap 16 as they are received by the extension 26 and ridges 27. In yet other embodiments, after being received by the extensions 26 and ridges 27, the plurality of light emitting units can be fastened to the at least one trim cap 16 by using a screw, nail, rivet or the like.

The at least one trim cap 16 can be arranged in many different ways to allow the plurality of light emitting units 20 to be received by the at least one trim cap 16. For example, FIG. 1*c* shows a portion of a cross section view of the channel letter housing 11 along the line B-B. FIG. 1*c* discloses an embodiment of the at least trim cap 16 wherein the extensions 26 and ridges 27 are elongated and extend along part of the at least one trim cap 16. In this embodiment, the at least one trim cap 16 provides an extended length of the extension 26 and ridges 27 that can secure substantially all of the light emitting unit 20. An advantage of the invention is that the elongated extensions 26 and ridges 27 provide a constant surface or structure that can hold the light emitting units 20 in place. In another embodiment, the at least one trim cap 16 can be arranged such that the extensions 26 and the ridges 27 extend along the entire length of the at least one trim cap 16. In yet another embodiment, the at least one trim cap 16 can comprise a plurality extensions 26 and ridges 27 such that the extensions 26 and ridges 27 provide a shortened length of the extensions 26 and ridges 27 instead of an extended length. In this arrangement, the extensions 26 and ridges 27 provide a plurality of surfaces that can hold the light emitting units 20 in place. The plurality of extensions 26 and ridges 27 can extend along part of the at least one trim cap 16, or can be arranged to extend along the entire length of the at least one trim cap 16. In still other embodiments, the at least one trim cap 16 does not comprise the extensions 26 and the ridges 27, such that the plurality of light emitting units 20 are coupled onto the at least one trim cap 16. The plurality of light emitting units 20 can be coupled using many different methods, such as but not limited to double-sided tape, glue, epoxy, bonding agents, fasteners, nails, screws, rivets, or the like, or a combination thereof.

Each of the plurality of light emitting units 20 comprise at least one light emitting element 21 on a printed circuit board (PCB) 23 and first and second conductors 13, 15 in electrical connection with the PCB 23. As shown in FIG. 1*c*, each PCB 23 comprises crimp terminals 17 configured to receive each of the conductors 13, 15. The conductors 13, 15 are arranged to be a continuous length of conductors and are center-stripped such that the outer insulation of each conductor 13, 15 is removed, leaving part the center conductor 29 of each conductor 13, 15 exposed. The center conductor 29 of each conductor 13, 15 is received by a respective crimp terminal 17, whereby a force is applied to the crimp terminals 17 such that the crimp terminals are compressed tightly around the exposed center conductor 19 of each conductor 13, 15. The crimp terminals 17 can be soldered onto the PCB 23 using a reliable reflow, wave soldering or other solder processes known in the art. The crimp terminals 17 can be coupled to the PCB 23 using a number of different methods known in the art and is not intended to be limited to the embodiments disclosed herein.

An advantage of the invention is that the conductors 13, 15 can be center-stripped at regular intervals, which provides a continuous length of conductors 13, 15 with exposed center conductors 29 of controlled lengths at regular intervals. Center-stripping the conductors 13, 15 at controlled regular intervals allows the PCB 23 to be separated from adjacent PCBs by a spacing corresponding to the controlled regular intervals. This eases the construction and spacing of the lighting units 20 because the exposed center conductors 29 of the conductors 13, 15 provide a visual indication as to where the PCBs 23 are to be connected to the conductors 13, 15. Using center-stripped conductors 13, 15 also eliminates the need of having to cut and strip numerous conductors, especially when connecting a plurality of PCBs into a daisy chain configuration to form an array of lighting units. The center-stripped conductors significantly reduces the amount of time needed to connect numerous PCBs when forming a long array of lighting units, as well as reducing costs related to manufacturing.

Yet another advantage of using center-stripped conductors is that the exposed center conductors 29 provides a large surface area of exposed center conductor to make positive, reliable contact to the crimp terminals on the PCBs. The crimp terminals 17 when crimped or compressed onto the center conductors 29 firmly holds the conductors 13, 15 in place preventing the center conductor 29 from being released from crimp terminals, which can also provide structural support to the PCB and the lighting units. The conductors 13, 15 being continuous and not cut when connected to the crimp terminals makes pulling the conductors out of the crimp terminal 17 more difficult than if the conductors were cut and crimped in the crimp terminal 17.

The conductors 13, 15 can be electrically connected to the PCB 23 using many different methods, and the invention is not intended to be limited to the embodiments disclosed herein. In other embodiments, the conductors 13, 15 can be electrically connected to the PCB by soldering. In yet other embodiments, Insulation Displacement connectors (IDC) or Insulation Piercing connectors (IPC) can be used to electrically connect the conductors to the PCB 23.

In one embodiment, the conductors 13, 15 can be on the same surface of the PCB 23 as the light emitting elements 21. However, in other embodiments, the conductors can be on either side of the PCB 23. The conductors 13, 15 electrically couple the electrical signal on the conductors 13, 15 to their respective one of the lighting units 20. The PCB 23 can also comprise conductive traces (not shown) to conduct electrical signals from the conductors 13, 15 to the light emitting elements 21 so that an electrical signal applied to the conductors is conducted to the light emitting elements through the traces, causing the light emitting elements to emit light.

The lighting emitting units 20 can be configured in many different configurations and is not intended to be limited to the embodiments disclosed herein. The embodiment of the light emitting units 20 in FIG. 1*c* disclose that the PCB 23, conductors 13, 15, light emitting elements 21 and optical elements 22 are exposed and not within a housing. In such embodiment, the light emitting units 20 can be covered with a coating or encapsulation to protect the light emitting units 20. However, in other embodiments, the light emitting units 20 can comprise a housing such that part of the PCB and/or the conductors are covered. The housing can be an overmold housing that is overmolded onto at least part of the PCB and conductors, such that the light emitting elements 21 are exposed.

In one embodiment of the invention, such as FIG. 2*a*, the components of the plurality of light emitting units 20 are exposed such that the PCB 23 and the at least one light emitting elements 21 and connected in a daisy chain configuration such that a plurality of conductor pairs 13, 15 are soldered to adjacent PCBs. In such embodiments, the light emitting units 20 can be covered with a coating or encapsulation to protect the light emitting units 20. In other embodiments, such as FIG. 2*b*, the light emitting units 20 comprise a housing 19 that encloses at least part of the PCB 23 and the conductors 13, 15 within the housing 19, with the light emitting elements 21 being exposed. The housing 19 can be an overmolded housing or can be comprised of a plurality of prefabricated parts that are assembled together to form the housing 19. The light emitting unit 20 of FIG. 2*b* can also comprise center-stripped conductors 13, 15 (not shown) and respective crimp terminals (not shown) similarly as discussed in the embodiment of the light emitting unit of FIG. 1*c*, or the conductors 13, 15 can be soldered onto the PCB, or electrically connected to the PCB using IDCs or IPCs. The light emitting elements 21 can be light emitting diodes (LED), however other light sources known in the art can be used and the invention is not intended to be limited to LED light sources.

At least one optical element 22 is proximate the plurality of light emitting units 20. The at least one optical element 22 is adapted to direct light emitted from the plurality of light emitting units 20 in a direction away from the light transmissive face 12 and towards the rear wall 14 or towards the opposing side wall surface 18 of the at least one trim cap 16. The light emitted by the plurality of light emitting units 20 is thereby reflected by the rear wall or by the opposing side wall surface and directed towards the face and emitted out the channel letter housing 11. The at least one optical element 22 directs substantially all light emitted from the light emitting units 20 across the interior of the channel letter housing 11 towards the opposing side wall surface and/or the rear wall 14, wherein the emitted light from the light emitting units 20 is reflected at least once by either the opposing side wall surface or the rear wall 14 before being emitted out the channel letter housing 11. The light emitted by the light emitting units 20 can be reflected by the opposing side wall surface and/or the rear wall multiple times within the housing 11 before being directed to the face 12 and emitted out the housing 11. In one embodiment, the rear wall and/or the side wall surfaces 18 of the at least one trim cap 16 can be made of reflective material. In other embodiments, a layer of reflective material can be disposed on the rear wall and/or the side wall surfaces 18, wherein the light emitted by the light emitting units is reflected by the layer of reflective material. In yet another embodiments, the rear wall can be made of reflective material and the side wall surfaces can comprise the layer of reflective material, vice versa, or a combination thereof.

An advantage of the invention is that optical element 22 directs the light towards the rear wall 14 and/or opposing side wall surface 18 which causes the light to reflect one or more times within the housing 11 in order to give the appearance that the channel letter housing 11 has a continuous light source. Furthermore, the light emitted at the light transmissive face 12 is substantially evenly diffused along the light transmissive face 12 and does not display hot spots or dark spots. Directing the emitted light away from the face 12 and towards the rear wall 14 and the opposing side wall surface allows standard ⅛ inch or 3/16 inch nominal acrylic material to be used for the face 12 in order to form low profile channel letters. As previously stated, conventional low profile channel letters require a very thick, diffusive and expensive acrylic for the face material. Thus, the invention reduces variable costs factors, such as but not limited to manufacturing, shipping and installation.

The at least one optical element 22 can be arranged in many different configurations. In one embodiment, each of the light emitting units 20 comprise at least one light emitting element 21, wherein at least one optical element 22 is proximate a respective one of the at least one light emitting element 21. The optical element can be arranged to have light altering properties such that the light emitted from the lighting unit 110 is redirected in order to produce a desired light distribution pattern, such as but not limited to a uniform light distribution pattern or a directional light distribution pattern. The optical element 22 can be a lens that covers a respective one of the light emitting element 21, such that the lens is adapted to direct the light away from the face 12 and towards the rear wall 14 and/or the opposing side wall surface 18. The optical properties of the lens allows the emitted light from the light emitting elements 21 to be directed in desired patterns, such as towards the rear wall and the opposing side wall surface and not towards the face 12. In other embodiments, each optical element 22 is arranged to comprise a plurality of lens to direct the light from the light emitting elements 21 away from the face 12 and towards the rear wall 14 and/or the opposing side wall surface 18. While in other embodiments, each of the light emitting units 20 comprise a lens covering all of the light emitting elements 21 of the respective light emitting units 20.

In other embodiments, the at least one optical element 22 can be a reflector, wherein each of the light emitting units 20 comprises at least one reflector proximate a respective one of the at least one light emitting elements 21. The at least one reflector comprises at least one reflective surface proximate the respective one of the light emitting element 21 and arranged to direct light emitted from the at least one light emitting elements toward the rear wall 14 and/or the opposing side wall surface 18 of the at least one trim cap 16. The at least one reflector causes the light emitted from the at least one light emitting elements 21 to be reflected at least once within the housing 11 before being directed towards the light transmissive face 12 and out the housing. In one embodiment, the reflector comprises a curved reflective surface. The reflector can be arranged in many different configurations and is not intended to be limited to a curved reflective surface. In other embodiments, the reflector can further comprise a flat surface, non-uniform surface, multi-faceted surface or a combination thereof. Additionally, the light emitting units 20 can be arranged to comprise a reflector proximate all of the light emitting elements 21. The reflector can be arranged to be a separate structure or part of a housing of the light emitting units. In other embodiments the optical element can be in the form of a lens, a diffuser, or a reflector proximate the light emitting elements, or a combination thereof. The optical element can be arranged to diffuse the light emitted from light emitting elements 21 so that the light emitted from the light emitting units have an even light distribution pattern.

The light emitting units 20 can be arranged in many different configurations and is not intended to be limited to the embodiments disclosed herein. In some embodiments the light emitting units 20 can be arranged to substantially conform to the shape of the structure to which the light emitting units 20 are mounted. For example, the light emitting units 20 can comprise a flexible PCB, such that the flexible PCB is adapted to be bent in many different directions. In other embodiments, the light emitting units 20 comprise a flexible PCB, at least one light emitting element 21 and a flexible housing covering at least part of the flexible PCB, wherein the light emitting units 20 can be bent or shaped to accommodate the surface to which it is being mounted on.

FIGS. 3*a*-3*b* disclose another embodiment of the channel letter lighting system according to the invention. In the embodiment of FIG. 1*a*-1*c*, the channel letter housing 11 is in the form of the letter "T", wherein one trim cap 16 is used to receive the face 12 and rear wall 14 to form the side wall surfaces 18. FIG. 3*a* discloses a channel letter lighting system comprising a channel letter housing 41 in the form of the letter "O", such that a first trim 44 and a second trim cap 46 receive the face 12 and rear wall 14 to form the opposing side wall surfaces 50, 52. For the same or similar elements or features, the same reference numbers will be used throughout the application herein.

The channel letter lighting system 40 includes a channel letter housing 41 comprising a light transmissive face 12, a rear wall 14 opposite the light transmissive face and a plurality of trim caps 44, 46. The plurality of trim caps are comprised of a first trim cap 44 and a second trim cap 46. However, in other embodiments, the channel letter lighting system can comprise more than two trim caps. The first and second trim caps 44, 46 are arranged to receive the light transmissive face 12 and the rear wall 14, in a manner similar to the at least one trim cap 16 of FIGS. 1*a*-1*c*, to form a first and second side wall surfaces 50, 52, wherein the first side wall surface 50 is opposite the second side wall surface 52. The channel letter lighting system further comprises a plurality of light emitting units 20 within the channel letter housing 42 that are adapted to emit light in response to an electrical signal, such that when illuminated, the plurality of light emitting units 20 give the appearance that the channel letter housing 42 has a continuous light source. The plurality of light emitting units 20 also comprise the at least one optical element 22 as discussed above. The light emitting units 20 of channel letter lighting system 40 are similar to the light emitting units 20 that can be used in the channel letter lighting system 10.

More than one trim cap is required to receive the face 12 and rear wall 14 due to the shape of the face 12 and rear wall 14. The letter "O" has an outer edge 41 and an inner edge 43, and such arrangement does not allow for only one trim cap to be used to form the side wall surfaces 50, 52. As such, the outer edge 41 is received by a slot 45 of the first trim cap 44 and the inner edge 43 is received by a slot 47 of the second trim cap 46. In other embodiments, the channel letter housing can be arranged to comprise more than one inner edge, such as but not limited to having a shape of "B" or "8", such that more than two trim caps are necessary. The light transmissive face 12 can be coupled to the first and second trim caps 44, 46 in a manner similarly as discussed above for the embodiment of FIGS. 1*a*-1*c*. The first trim cap 44 extends along the outer perimeter of the face 12 and the second trim cap 46 extends along the inner perimeter of the face. The rear wall 14 is coupled a recess 49 of the first trim cap 44 and to a recess 51 of the second trim cap 46 to form the channel letter housing 41, in a manner similar to the embodiment of FIGS. 1*a*-1*c*.

The light emitting units 20 are arranged to emit light away from the face 12 and towards the opposing side wall surface or the rear wall 14, such that the light is reflected by the opposing side wall surface or the rear wall 14 and then directed toward the face 12 and emitted out the channel letter housing 41. FIG. 3*b* shows a cross sectional view of the channel letter lighting system 40 of FIG. 3*a* along the line C-C. In this embodiment, the light emitting unit 20 is on the first trim cap 44. The first trim cap 44 can be configured to hold the light emitting units 20 in a manner similar to the at least one trim cap 16. The light emitted from the light emitting unit 20 is directed by the optical element 22 away from the face 12 towards the rear wall 14 and/or the second trim cap 46, which is opposite the first trim cap 44. The emitted light is reflected at least once within the channel letter housing 41 before it is emitted towards the face 12 and out the channel letter housing 41. In other embodiments, the light emitting units 20 can be on either the first or second trim caps 44, 46 and is not intended to be limited to the embodiments disclosed herein. In yet other embodiments, the light emitting units 20 can be on both the first and second trim caps 44, 46. The first and second trim caps 44, 46 can be configured similarly as the at least one trim cap 16 and/or made of the same or similar material as the at least one trim cap 16.

Although the invention has been described in considerable detail with reference to certain configurations thereof, other versions are possible. For example, the channel letter housing can be in form of many different shapes, such as but not limited to alphanumeric text, symbols, designs, or the like. The conductors can be different lengths and instead of running uninterrupted between the units, the conductors can have connectors. This would allow the units to be supplied separately and then connected together when installed. Therefore, the spirit and scope of the invention and should not be limited to the embodiments described above.

We claim:

1. A channel letter lighting system, comprising:

a channel letter housing having a light transmissive face, a rear wall opposite said light transmissive face, and at least one trim cap arranged to receive said light transmissive face and said rear wall to form side wall surfaces of said channel letter housing, wherein said at least one trim cap comprises a slot and a recess, wherein said light transmissive face is received by said slot, and said rear wall is received by said recess;

a plurality of light emitting units on said at least one trim cap;

at least one optical element proximate said plurality of light emitting units and configured to direct light emitted from said plurality of light emitting units in a direction away from said light transmissive face and towards said rear wall or an opposing side wall surface, such that the light emitted from said plurality of light emitting units is reflected by said opposing side wall surface or said rear wall towards said light transmissive face and emitted out from said housing.

2. The channel letter lighting system of claim 1, wherein said at least one trim cap is configured to receive said plurality of light emitting units.

3. The channel letter lighting system of claim 1, wherein said at least one trim cap extends along at least one edge of said light transmissive face and said rear wall to form said side wall surfaces.

4. The channel letter lighting system of claim 1, wherein light emitted from said channel letter housing is evenly distributed across said light transmissive face.

5. The channel letter lighting system of claim 1, wherein said plurality of light emitting units comprises a flexible strip of light emitting elements.

6. The channel letter lighting system of claim 1, wherein said at least one optical element is a reflector.

7. The channel letter lighting system of claim 1, wherein said at least one optical element is a diffuser.

8. The channel letter lighting system of claim 1, wherein said at least one optical element is a lens.

9. The channel letter lighting system of claim 1, wherein said at least one optical element is arranged to direct light emitted from said plurality of light emitting units across the interior of said housing and towards at least one of said opposing side wall surface or said rear wall.

10. The channel letter lighting system of claim 9, wherein said directed light reflects off at least one of said rear wall or said at least one of said opposing side wall surface prior to being transmitted out from said housing.

11. The channel letter lighting system of claim 1, said at least one trim cap comprising:

an internal surface and an external surface;

first and second extensions on said internal surface, wherein each of said first and second extensions comprise a respective ridge such that said plurality of light emitting units can be received by said first and second extensions and secured by said respective ridges.

12. The channel letter lighting system of claim 1, wherein light emitted from said plurality of light emitting units is internally reflected within said housing at least once before being emitted out said light transmissive face.

13. The channel letter lighting system of claim 1, wherein said light transmissive face comprises ⅛ inch or 3⁄16 inch acrylic face material.

14. The channel letter lighting system of claim 13, wherein said channel letter lighting system is a low profile channel letter system.

15. A channel letter lighting system, comprising:

a channel letter housing including a front surface, a rear wall, and at least one trim cap along at least one edge of said front surface and said rear wall;

an array of light emitting units mounted within said channel letter housing, each of said light emitting units comprising:

at least one light emitting element on a printed circuit board (PCB);

first and second conductors electrically connected to said at least one light emitting element and adapted to provide an electrical signal to said at least one light emitting element; and at least one optical element proximate said at least one light emitting element, wherein said at least one light emitting element is adapted to emit substantially all light towards opposing surfaces of said at least one trim cap or said rear wall, wherein said array of light emitting units is on said at least one trim cap;

wherein light emitted from said array of light emitting units has a light distribution pattern to form a uniform light emission through said front surface;

wherein said at least one trim cap comprises a slot and a recess, wherein said front surface is received by said slot, and said rear wall is received by said recess.

16. The channel letter lighting system of claim 15, wherein said at least one trim cap is arranged to receive said array of light emitting units.

17. The channel letter lighting system of claim 15, wherein said at least one optical element comprises a reflector proximate said at least one light emitting element and arranged to direct light emitted from said at least one light emitting element towards said rear wall or at least one of said opposing surfaces of said at least one trim cap.

18. The channel letter lighting system of claim 15, wherein said at least one optical element comprises a lens covering said at least one light emitting element and arranged to direct light emitted from said at least one light emitting element towards said rear wall or at least one of said opposing surfaces of said at least one trim cap.

19. The channel letter lighting system of claim 15, wherein said at least one optical element comprises of a plurality of reflectors proximate a respective one of said at least one light emitting elements of said array, such that each of said plurality of reflectors directs light towards said rear wall or at least one of said opposing surfaces of said at least one trim cap.

20. The channel letter lighting system of claim 15, wherein said at least one optical element comprises a plurality of lenses covering a respective one of said at least one light emitting element of said array, such that each of said plurality of lenses directs light towards said rear wall or at least one of said opposing surfaces of said at least one trim cap.

21. The channel letter lighting system of claim 15, wherein said front surface is a light transmissive surface.

22. The channel letter lighting system of claim 15, wherein said first and second conductors are a continuous length of conductors in electrical connection with each of said light emitting units of said array.

23. The channel letter lighting system of claim 15, wherein each of said light emitting units comprises a housing adapted to cover at least part of said PCB and said first and second conductors.

24. The channel letter lighting system of claim 23, wherein said housing is an overmolded housing.

25. The channel letter lighting system of claim 15, wherein said at least one optical element is arranged to direct light emitted from said plurality of light emitting units across the interior of said housing and towards at least one of said opposing surfaces of said at least one trim cap or said rear wall.

26. The channel letter lighting system of claim 25, wherein said directed light reflects off at least one of said rear wall or said opposing surface prior to being transmitted out from said housing.

27. The channel letter lighting system of claim 15, wherein said front surface and said rear wall comprise an outer edge and at least one inner edge, such that a first trim cap receives said outer edge of said front surface and said rear wall, and said at least one inner edge is received by a respective trim cap in order to form said channel letter housing.

28. The channel letter lighting system of claim 15, wherein said front surface comprises ⅛ inch or 3⁄16 inch acrylic face material.

29. The channel letter lighting system of claim 28, wherein said channel letter lighting system is a low profile channel letter system.

30. A channel letter lighting system, comprising:

a channel letter housing including a front surface, a rear wall, and at least one trim cap along at least one edge of said front surface and said rear wall;

an array of light emitting units mounted within said channel letter housing, each of said light emitting units comprising:

at least one light emitting element on a printed circuit board (PCB);

first and second conductors electrically connected to said at least one light emitting element and adapted to provide an electrical signal to said at least one light emitting element, wherein said first and second conductors are a continuous length of conductors in electrical connection with each of said light emitting units of said array; and at least one optical element proximate said at least one light emitting element, wherein said at least one light emitting element is adapted to emit substantially all light towards opposing surfaces of said at least one trim cap or said rear wall, wherein said array of light emitting units is on said at least one trim cap;

wherein light emitted from said array of light emitting units has a light distribution pattern to form a uniform light emission through said front surface, wherein each PCB of said light emitting unit comprises a pair of crimp terminals, wherein said first and second conductors are center-stripped such that an exposed center conductor of said first and second conductors is received by a respective one of said pair of crimp terminals.

31. The channel letter lighting system of claim 30, said at least one trim cap comprising a slot and a recess, wherein said front surface is received by said slot, and said rear wall is received by said recess.

32. The channel letter lighting system of claim 30, wherein said front surface comprises ⅛ inch or 3⁄16 inch acrylic face material.

33. The channel letter lighting system of claim 32, wherein said channel letter lighting system is a low profile channel letter system.

* * * * *